United States Patent [19]

Stone

[11] Patent Number: 4,690,285

[45] Date of Patent: Sep. 1, 1987

[54] DISPENSING RECEPTACLE FOR DRAFTING EQUIPMENT

[76] Inventor: Earlyn W. Stone, 1109 Ridgecrest Cir., Costa Mesa, Calif. 92627

[21] Appl. No.: 800,828

[22] Filed: Nov. 22, 1985

[51] Int. Cl.[4] ..... A47G 19/08

[52] U.S. Cl. ..... 211/41; 248/441.1; 248/442.2

[58] Field of Search ..... 211/41, 13, 59.2, 60.1, 211/81, 89, 100, 126, 132, 171, 88; 248/278, 441.1, 450, 473, 442.2; 206/371, 45.14

[56] References Cited

U.S. PATENT DOCUMENTS

| | | | |
|---|---|---|---|
| 500,715 | 7/1893 | Leslie | 248/442.2 |
| 598,689 | 2/1898 | Wilson | 248/442.2 X |
| 651,058 | 6/1900 | Rogers | 248/441.1 |
| 1,128,324 | 2/1915 | Jones | 248/441.1 X |
| 2,591,805 | 4/1952 | Gossett | 211/89 |
| 3,819,039 | 6/1974 | Erickson | 211/89 X |
| 4,373,639 | 2/1983 | Tricon | 211/13 X |

*Primary Examiner*—Ramon S. Britts

*Assistant Examiner*—Sarah A. Lechok Eley

*Attorney, Agent, or Firm*—Plante Strauss Vanderburgh

[57] ABSTRACT

There is disclosed a receptacle for storing and dispensing flat tools and utensils, particularly drafting instruments such as templates, shields, compasses, dividers, pencils, pens, etc. The receptacle comprises a U-shaped box having a base with opposite sidewalls coextensive its side edges, a plurality of cross slots extending through said box sidewalls; and an elastomeric retainer member received in said U-shaped box, substantially filling the box between its sidewalls, with a like plurality of cross slits aligned with said plurality of cross slots. The drafting instruments are received in the cross slots and are snuggly captured by the slits in the elastomeric retainer member. In its preferred embodiment, the receptacle is mounted on the side of a rack having a back and an integral tray dependent from its lower forward edge, and most preferably, a pair of such receptacles are mounted, one at each side of the rack, and the rack is mounted to a drafting table with a balanced arm that is cantilevered from a upright standard.

17 Claims, 4 Drawing Figures

DISPENSING RECEPTACLE FOR DRAFTING EQUIPMENT

BACKGROUND OF THE INVENTION

1. Field of the Invention

This invention relates to storage and dispensing receptacles, and in particular to a dispensing receptacle for drafting tools and instruments.

2. Brief Statement of The Prior Art

Large, flat objects such as the triangles, templates, shields, pens, pencils, dividers, compasses, etc., used for drafting are cumbersome and no efficient storage system has been provided which will readily store the instruments for easy access and retrival. Some draftsmen tie cords to the instruments and secure one end of each cord to their drafting table. Other draftsmen place these instruments in trays and drawers of the drafting tables. Typically, some of the instruments fall to the floor or become jumbled with other instruments in a drawer or tray, and the instruments are often lost or damaged, and are located or retrived only with difficulty, and after interrupting the drafting operation.

BRIEF STATEMENT OF THE INVENTION

This invention comprises a storage receptacle for flat objects such such as triangles, templates, compasses, and other instruments used by draftsmen. The receptacle comprises a U-shaped box having a base with opposite, longitudinal sidewalls coextensive its side edges, a plurality of cross slots extending through said box sidewalls; and an elastomeric retainer member received in said U-shaped box, substantially filling the box between said sidewalls, with a like plurality of cross slits aligned with said plurality of cross slots. The drafting instruments are received in the cross slots and are snuggly captured by the slits in the elastomeric retainer member. In its preferred embodiment, the receptacle is mounted on the side of a rack having a back and an integral tray dependent from its lower forward edge, and most preferably, a pair of such receptacles are mounted, one at each side of the rack, and the rack is mounted to the free end of a cantilevered, balanced arm which is supported from a upright standard having a base that is fixedly secured to a drafting table.

BRIEF DESCRIPTION OF THE DRAWINGS

The invention will be described wtih reference to the FIGURES, of which.

DESCRIPTION OF PREFERRED EMBODIMENTS

Figure 1:
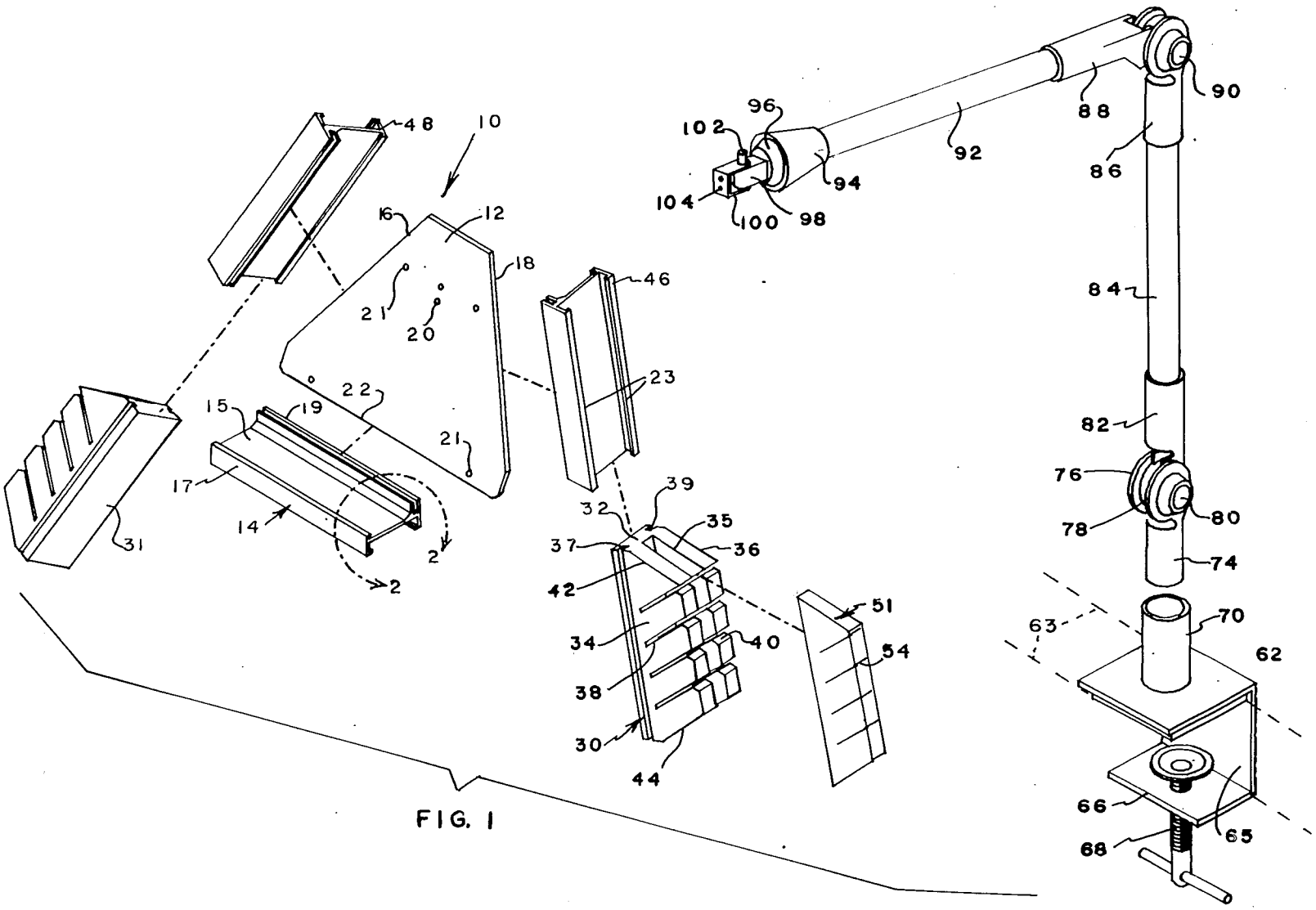
FIG. 1 is an exploded, perspective view of the receptacle and rack assembly of the invention with a balanced, cantilevered arm support.

The invention is shown in exploded, perspective view in FIG. 1 as an assembly 10 of a rack 12 with a forward dependent tray 14 at its lower edge 22. The rack has lateral edges 16 and 18 which extend rearwardly from its side edges, and preferably, the rack has the shape of a trapezoid with a long, lower edge 22, resulting in an incline of 45° to 75° of sides 16 and 18, relative to lower edge 22. At least one, and preferably, two apertures 20 are centrally located in the rack 12 for support of the rack from a suitable member, and additional apertures 21 can be provided for attachment of a suitable handle, not shown.

Figure 2:
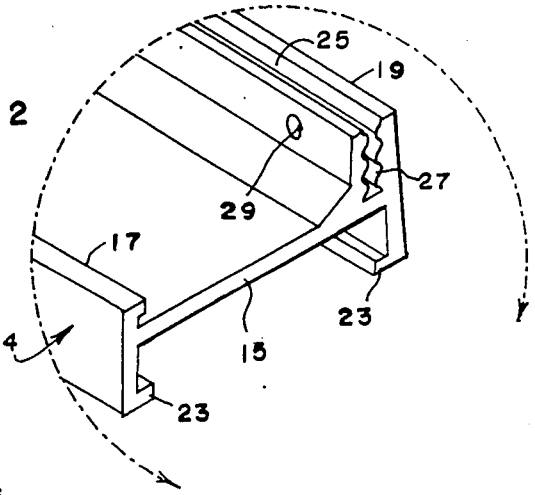
FIG. 2 is a view on area 2—2' of FIG. 1.

The tray 14 is preferably an extrusion having the general shape of an I-beam with a web 15 and sides 17 and 19. The preferred construction is shown in greater detail in FIG. 2 which shows longitudinal lips 23 on both edges of side 17, and on one of the edges of side 19. The remaining edge of side 19 has a longitudinal slot 25 which extends substantially its entire depth, and most preferably, this slot 25 has sidewalls which have a plurality of V-grooves 27 with arcuate sides. In the assembly, slot 25 receives the edge, such as 22, of rack 12, and the arcuate V-grooves 27 provide a secure retention of the received edge of the rack. If desired, this assembly can be cemented with a suitable permanent adhesive and/or one or more fasteners, such as screws or rivets, (not shown) can be received in apertures such as 21 in the rack 12 and 29 in the tray 14.

The receptacle 30 of the assembly 10 is a generally U-shaped box with a base web 32 and opposite sides 34 and 36 and a longitudinal central slot 35 coextensive its length. Preferably, the shape of the sides 34 and 36 is also trapezoidal, with inclined upper edge 42 and inclined lower edge 44. A plurality of cross slots 38 are provided which extend entirely across the sides 34 and 36 and extend substantially to the web 32. The lower, outside edge of the slots is preferably chamfered as shown at 40, and the slots are inclided at an angle from 20 to about 89 degrees to the base 32 of the receptacle.

An elastomeric core member 50 is received in the central longitudinal slot 35 of the receptacle 30. This core member has the same shape as the sidewalls 34 and 36 and a sufficient width to substantially completely fill the central longitudical slot 35. The elastomeric core member 50 has a plurality of cross slits 54 which are spaced at the same increments, and have the same angular oritentation to its base 56, as do cross slots 38. The core member 50 is received in the central longitudinal slot 35 with its cross slits 54 aligned with the cross slots 38 of the receptacle 30. The receptacle can be permanently secured in the slot 35 by any suitable means, e.g., by an adhesive, or can simply be compressed or wedged into the slot 35.

As shown in FIG. 1, the assembly has a pair of receptacles 30 and 31, located at opposite sides of the rack member 12. The receptacles are assembled to the sides 16 and 18 of the rack member 12 by extrusion brackets 46 and 48, which can have the same shape and size as the extruded tray 14, previously described with reference to FIG. 2. The extrusion brackets 46 and 48, are reversed, side-to-side, from the extruded tray 14, thereby exposing their sides with the two opposite longitudinal lips 23 and thus forming a track for receiving the receptacles 30 and 31. To secure the assembly, the receptacles 30 and 31 are provided with longitudinal grooves 37 and 39 along the opposite sides of their bases 32 and lips 23 of the extrusion brackets 46 and 48 are received in these grooves. In normal assembly, the receptacles are snuggly received in the extrusion brackets and no further assembly retention means need be used. If desired, however, any suitable assembly retention means can be used, e.g., permanent adhesives, screw fasteners, rivets, etc., can be used to retain the receptacles 30 and 31 in their supporting extrusion brackets 46 and 48. Also, as mentioned for tray 14, similar additional assembly retention means can be used to retain the assembly of the extrusion brackets 46 and 48 on the edges 16 and 18 of rack 12.

Rack member 12 can be formed of wood, metal or plastic, although plastic is preferred, since it can be readily formed from plastic sheet material, such as sheets of polyacrylates, polycarbonate, polyethylene, polypropylene, etc. having thicknesses from about 0.067 to about 1.0 inch, preferably from about 0.125 to about 0.5 inch. The receptacle can be formed of a suitable light weight material, e.g., low density wood such as balsa wood, but is preferably formed of rigid plastic foam having a suitable low density such as rigid polystyrene foam, polyethylene foam, polyurethane foam, etc. Typically these foams can be obtained in bulk form with densities from about 0.2 to about 5 pounds per cubic foot, and polystyrene foams having densities from about 0.25 to about 2 pounds per cubic foot are preferred, as these foams have sufficient strength and are readily available for use in the invention. Alternatively, the receptacle member 30 can be formed of plastic sheet material such as that used for the rack member 12.

The elastomeric retainer members such as 50 are formed of elastomeric materials such as natural and synthetic rubbers, and are preferably also of low density to reduce the weight of the assembly 10. For this purpose, the elastomeric material can be foamed with closed cells and suitable materials include foam rubber, polyurethane foam, budiene-styrene foamed rubber with or without acrylonitrile comomer. The density of the foamed elastomeric material can be from about 3 to about 12, preferably from about 3.5 to about 8 pounds per cubic foot.

The assembly 10 is shown in FIG. 1 with a suitable support means generally indicated at 60. Any conventional support that provides a balanced, cantilevered arm can be used such as those provided for the support of lamps and magnifier lamps. The illustrated support is a conventional support which is used for desk magnifier lamps, and includes a base 62 which is adapted for fixed attachment to a work surface to the edge 64 (shown in phantom lines 63) of a drafting table. The base 62 can be of a C-clamp construction with a lower bracket 66 which threadably receives a clamp screw 68, whereby the base can be fixedly secured to a table. A pad of plastic 65 can be provided on the undersurface of bracket 62 to prevent marring of the desk surface.

A tubular support boss 70 is permanently secured to top surface of the base 62, and this boss 70 rotatably receives the tubular end 74 of swivel bracket 72. At its upper end, bracket 72 has a pair of opposite discs 76 and 78 which receive a threaded fastener secured with a knob fastener 80. A similar bracket 82 is pivotably mounted to bracket 72 about the screw fastener, thereby permitting any desired inclination to the tubular standard 84, which is received and secured in bracket 82. At its upper end, standard 84 supports a duplicate assembly of pivot brackets 86 and 88, which are compressed by knob fastener 90. The support arm 92 is received and secured in the bracket 88. Each of the two assemblies of pivot brackets contain a torsion spring (not shown), which provides balance to the cantilevered arms, such as support 84 and arm 92, thereby counterbalancing the weight of these members as well as the weight of the receptacle assembly 10 of the invention, and any items which are placed thereon.

At its free end, arm 92 carries a support bracket 100 which has a pair of apertures 104 which align with apertures 20 of rack 13 and which receive fasteners such as screw fasteners or rivets (not shown) to secure the assembly. Bracket 100 is pivotally mounted on post 98 that extends from sleeve 96, and the position of bracket 100 on post 98 is fixedly secured by a screw fastener with knob fastener 102 to compress the bracket 100 firmly onto the post 98. Sleeve 96 is received on the end of arm 92 and is rotatable thereon about the axis of the arm 92 through an arc of 90 degrees. An internally threaded and tapered sleeve 94 is threadably received on mating external threads of sleeve 96 so that the sleeve 96 can be compressed tightly about, and thus fixedly secured, to the end of arm 92.

Figure 3:
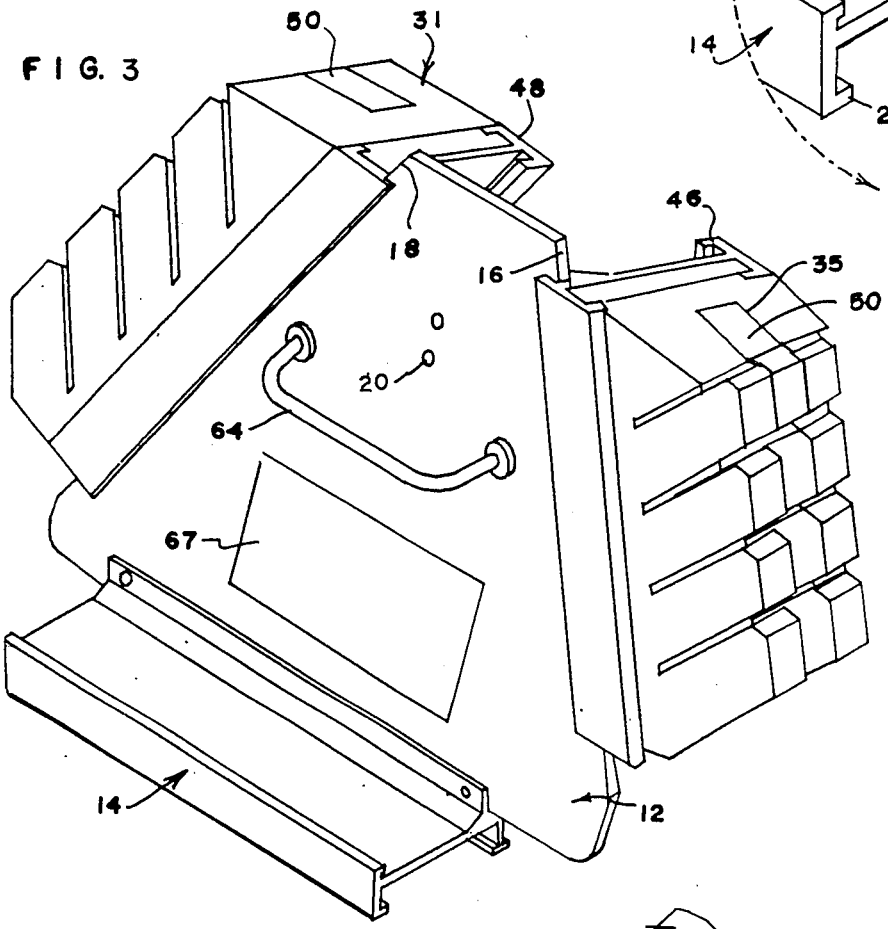
FIG. 3 is a perspective view of the receptacle and rack assembly of the invention.

The dispensing receptacle of the invention is shown in assembly in FIG. 3. As there illustrated, the elastomer retaining members such as 50 are seated in the longitudinal slots 34 of the receptacles 30 and 31, thereby providing a snug retention of items such as triangle 60. The receptacles 30 and 31 are mounted in the longitudinal tracks of brackets 46 and 48, and the latter are fixedly secured to their respective edges 16 and 18 of rack 12. The tray 14 provides support for various items such as pens or pencils. A handle 64 can be provided on the front of rack 12 to permit the user to move the assembly freely about, over the drafting table. The front surface of the rack can also be provided with printed indicia 67, such as tables of conversion factors of fractions to decimal values, or other information useful in drafting.

Figure 4:
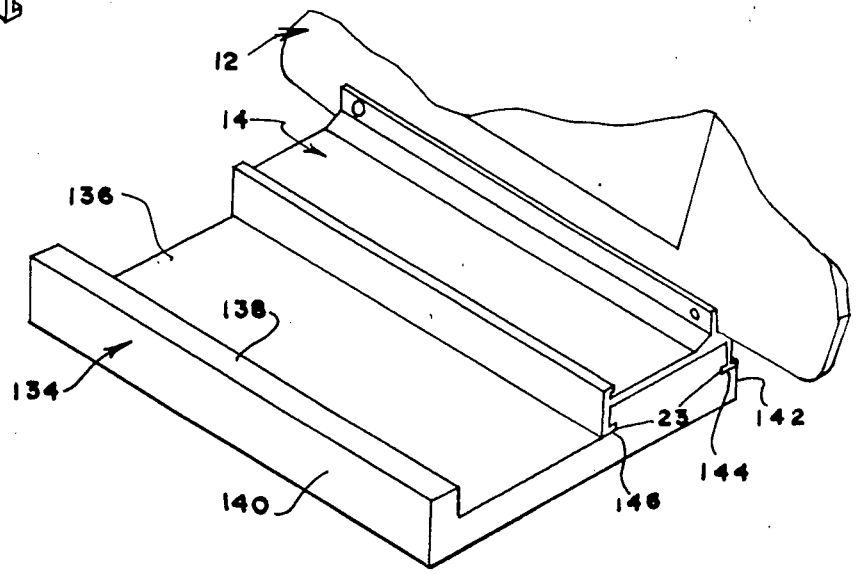
FIG. 4 is a view of a tray extension on the rack assembly shown in FIG. 3.

Referring now to FIG. 4, an extension tray 134 can be secured to the tray 14 of the rack assembly shown in FIG. 3. For this purpose, the extension tray 134 can be formed with a flat tray surface 136 and an upwardly directed lip 138 along side 140. The extension 134 is thicker along its opposite side 142, and has a longitudinal groove 144 along the opposite side 142, and a matching longitudinal groove 146 along its inner side. These grooves receive the inwardly directed lips 23 of the tray extrusion 14, thereby securing the tray extension 134 to the tray extrusion 14. Additional utensiles can be deposited in the tray extension 134.

The invention provides a compact storage for a plurality of flat instruments such as templates, triangles and the like which otherwise clutter the drafting table. The receptacle with its retainer member provides very secure retention of the instruments, yet readily releases the instruments. The receptacle can be used alone and fastened directly to a working surface, such as the top or sides of a drafting table, however, it is preferably used in the assembly shown in FIG. 1 with a cantilevered support arm that can be swung over the drafting table to retreive an instrumemt and swung away to clear the working area. Since the elastomeric retainer member grips the instruments firmly, they are not dislodged even though the assembly is moved about the work area.

The invention has been described with reference to the illustrated and presently preferred embodiment. It is not intended that this disclosure of the presently preferred embodiment be unduly restricting. Instead, it is intended that the invention be defined by the means, and their obvious equivalents, set forth in the following claims:

What is claimed is:

1. A storage member to removeably receive flat, stiff items such as drafting tools and the like which comprises:

(a) a U-shaped frame having a base with opposite side-walls coextensive its side edges to form a single central, coextensive and longitudinal channel, and a plurality of cross slots extending laterally across said frame completely through each of said frame sidewalls to thereby guide or support said items during insertion or retraction from storage member; and (b) an elastomeric retainer member received in said longitudinal channel of said U-shaped frame, substantially filling said channel between said sidewalls, with a like plurality of cross slits extending laterally across said member and aligned with said plurality of cross slots.

2. The storage member of claim 1 wherein said cross-slots are disposed at an inclined angle from 90 to about 30 degrees to the base thereof.

3. The storage member of claim 1 wherein said base and sidewalls are integral and formed of molded plastic.

4. The storage member of claim 3 wherein said molded plastic is rigid polystyrene foam.

5. A storage receptacle comprising:

(a) a rack having a back and an integral tray dependent from its lower forward edge;

(b) at least one storage member disposed on at least one edge of said rack and secured thereto, and comprising:

(i) a U-shaped frame having a base with opposite side-walls coextensive its side edges, and a plurality of cross slots extending through said frame sidewalls; and (ii) an elastomeric retainer member received in said U-shaped frame, substantially filling the bight between said sidewalls, with a like plurality of cross slits aligned with said plurality of cross slots.

6. The storage receptacle of claim 5 wherein said rack has at least one support bracket dependent from one of its lateral edges and wherein said storage member is fixedly secured in said support bracket.

7. The storage receptacle of claim 6 wherein said support bracket has a general I-beam shape with a center web and opposite sides, and wherein one of said sides has a longitudinal slot which is received over an edge of said rack, thereby securing said bracket to said rack.

8. The storage receptacle of claim 7 wherein the opposed sides of said support bracket have inwardly facing lips, defining a track and wherein said receptacle has longitudinal slots along its opposite sides to receive lips, thereby securing the receptacle to said support bracket.

9. The storage receptacle of claim 8 including two said storage members and two said brackets, with each receptacle fixedly secured to a respective one of said brackets dependent from said rack.

10. The storage receptacle of claim 5 including a stand comprising a base, upright standard dependent thereon, and a balanced arm cantilevered from said standard with said storage receptacle distally carried thereon.

11. The storage receptacle of claim 10 wherein said balanced arm has spring balance means.

12. The storage receptacle of claim 10 including clamp means on said base to fixedly secure said base to a work surface.

13. The storage receptacle of claim 5 including a tray carried on the bottom edge of said rack and wherein said tray comprises a member having a general I-beam shape with a center web and opposite sides, and wherein one of said sides has a longitudinal slot which is received over the bottom edge of said rack, thereby securing said tray to said rack.

14. The storage receptacle of claim 13 wherein said tray projects forwardly from said rack at an included angle of 90 degrees or less.

15. The storage receptacle of claim 14 also including a tray extension on said tray wherein said tray has a pair of opposed longitudinal lips on the bottom edges of its sides, and wherein said tray extension comprises a flat body with an outer upward lip and a pair of longitudinal grooves to receive the opposite lips of said tray.

16. The storage receptacle of claim 5 wherein said rack back is a trapezoid with with inclined side edges and a short, upper edge.

17. The storage receptacle of claim 16 wherein said side edges are inclined at an angle from 45 to 75 degrees to the lower edge of said back.

* * * * *